US009464807B2

(12) United States Patent
Kim et al.

(10) Patent No.: US 9,464,807 B2
(45) Date of Patent: Oct. 11, 2016

(54) COMBUSTOR

(71) Applicant: Hanwha Techwin Co., Ltd., Changwon-si (KR)

(72) Inventors: Sinhyun Kim, Changwon-si (KR); Seungchai Jung, Changwon-si (KR); Siwon Yang, Changwon-si (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 0 days.

(21) Appl. No.: 14/601,418

(22) Filed: Jan. 21, 2015

(65) Prior Publication Data

US 2015/0211740 A1 Jul. 30, 2015

(30) Foreign Application Priority Data

Jan. 24, 2014 (KR) ..... 10-2014-0009169

(51) Int. Cl.

| | |
|---|---|
| ***F02C 1/00*** | (2006.01) |
| ***F23R 3/14*** | (2006.01) |
| ***F23R 3/28*** | (2006.01) |
| ***F23R 3/34*** | (2006.01) |

(52) U.S. Cl.

CPC ..... *F23R 3/14* (2013.01); *F23R 3/286* (2013.01); *F23R 3/34* (2013.01); *F23R 2900/00015* (2013.01)

(58) Field of Classification Search

CPC ..... F23R 3/286; F23R 3/14; F23R 3/12; F02C 7/002; F02C 7/004

See application file for complete search history.

(56) References Cited

U.S. PATENT DOCUMENTS

| | | | | |
|---|---|---|---|---|
| 6,951,108 | B2 | 10/2005 | Burrus et al. | |
| 8,312,724 | B2 | 11/2012 | Dai et al. | |
| 8,322,142 | B2 | 12/2012 | Armstrong et al. | |
| 2004/0065090 | A1* | 4/2004 | Al-Roub et al. | 60/776 |
| 2005/0198965 | A1* | 9/2005 | Henriquez et al. | 60/740 |
| 2007/0202453 | A1* | 8/2007 | Knoepfel | 431/354 |
| 2008/0000234 | A1* | 1/2008 | Commaret et al. | 60/748 |
| 2009/0173076 | A1* | 7/2009 | Toon | 60/746 |
| 2010/0308135 | A1* | 12/2010 | Yamamoto et al. | 239/402 |
| 2012/0304649 | A1* | 12/2012 | Matsuyama et al. | 60/737 |
| 2014/0090382 | A1* | 4/2014 | Sandelis et al. | 60/740 |

FOREIGN PATENT DOCUMENTS

| | | |
|---|---|---|
| EP | 1 371 906 B1 | 9/2010 |
| JP | 2004-12123 A | 1/2004 |
| JP | 2012-154618 A | 8/2012 |

* cited by examiner

*Primary Examiner* — Gerald L Sung

(74) *Attorney, Agent, or Firm* — Sughrue Mion, PLLC

(57) ABSTRACT

Provided is a combustor including a support shaft, a wing portion provided on the support shaft and configured to swirl a first fluid around the support shaft, and a cover housing enclosing the support shaft and the wing portion and includes a space enlarging portion provided at a downstream of of the wing portion, where a distance of the space enlarging portion from an outer surface of the support shaft is different from distances of other portions of the cover housing from the outer surface of the support shaft.

18 Claims, 7 Drawing Sheets

COMBUSTOR

CROSS-REFERENCE TO RELATED APPLICATION

This application claims priority from Korean Patent Application No. 10-2014-0009169, filed on Jan. 24, 2014, in the Korean Intellectual Property Office, the disclosure of which is incorporated herein by reference in its entirety.

BACKGROUND

1. Field

Apparatuses consistent with exemplary embodiments relate to a combustor.

2. Description of the Related Art

A gas turbine is a type of heat engine which drives a turbine via high-temperature and high-pressure combustion gas, and generally includes a compressor, a combustor, and a turbine. Air that enters the gas turbine is compressed by the compressor in the gas turbine, fuel combustion is generated in a distributed manner by using the combustor, and the high-temperature and high-pressure air increases in the turbine, thereby power being produced in the above-described process.

In the combustor, an area where flames are fixed at a proper position without being swept away is referred to as a central recirculation zone (CRZ). To continuously maintain combustion and to accelerate mixing of fuel and an oxidizer in the combustor, it is important to maintain a proper CRZ according to flow.

For this purpose, a swirl needs to be applied to the flow. Generally, a nozzle for generating a swirl is called a swirler. Swirlers are classified into axial swirlers, radial swirlers, tangential swirlers, and cone swirlers, depending on a shape thereof.

Since the swirling strength is determined by the shape of the swirler, the swirling strength may not be controlled according to an engine operating environment and a driving condition.

SUMMARY

One or more exemplary embodiments provide a combustor capable of improving combustion efficiency.

Additional aspects will be set forth in part in the description which follows and, in part, will be apparent from the description, or may be learned by practice of the presented embodiments.

According to an aspect of an exemplary embodiment, there is provided a combustor including a support shaft; a wing portion provided on the support shaft and configured to swirl a first fluid around the support shaft; and a cover housing enclosing the support shaft and the wing portion and comprising a space enlarging portion provided at downstream of the wing portion in a flow direction of the first fluid, wherein a distance between the space enlarging portion and an outer surface of the support shaft is different from distances between other portions of the cover housing and the outer surface of the support shaft.

The combustor may further include a guide housing enclosing the cover housing.

The space enlarging portion may extend in a predetermined angle with respect to a longitudinal direction of the support shaft.

The space enlarging portion may include a fluid injection hole configured to inject a second fluid at a first angle with respect to a flow direction of the first fluid and a fuel injection hole configured to inject a fuel at a second angle with respect to the flow direction of the first fluid.

The second fluid and the fuel may be configured to circulate in the space enlarging portion through the fluid injection hole and the fuel injection hole, respectively.

The fluid injection hole may include a plurality of fluid injection holes provided at different heights of the space enlarging portion.

The space enlarging portion may extend spirally with respect to a longitudinal direction of the support shaft.

A cross-sectional area of the space enlarging portion may wary along a circumferential direction of the space enlarging portion.

The plurality of fluid injection holes may be provided at different heights with respect to a radial direction of the space enlarging portion.

The first angle and the second angle may be different from each other.

According to an aspect of another exemplary embodiment, provided is a combustor including a support plate, a support shaft provided on the support plate, a wing portion radially extending from the support plate and configured to swirl a first fluid toward a center of the support plate, and a cover housing enclosing the support shaft and the wing portion and comprising a space enlarging portion provided at downstream of the wing portion in a flow direction of the first fluid, wherein a distance between the space enlarging portion and an outer surface of the support shaft is different from distances between other portions of the cover housing and the outer surface of the support shaft.

The combustor may further include a guide housing enclosing the cover housing.

The space enlarging portion may extend in a predetermined angle with respect to a longitudinal direction of the support shaft.

The space enlarging portion may include a fluid injection hole configured to inject a second fluid at a first angle with respect to a flow direction of the first fluid and a fuel injection hole configured to inject a fuel at a second angle with respect to the flow direction of the first fluid.

The second fluid and the fuel may be configured to circulate in the space enlarging portion through the fluid injection hole and the fuel injection hole, respectively.

The fluid injection hole may include a plurality of fluid injection holes provided at different heights of the space enlarging portion.

The space enlarging portion may extend spirally with respect to a longitudinal direction of the support shaft.

A cross-sectional area of the space enlarging portion may wary along a circumferential direction of the space enlarging portion.

The plurality of fluid injection holes may be provided at different heights with respect to a radial direction of the space enlarging portion.

The first angle and the second angle may be different from each other.

BRIEF DESCRIPTION OF THE DRAWINGS

The above and/or other aspects of the disclosure will become apparent and more readily appreciated from the following description of exemplary embodiments, taken in conjunction with the accompanying drawings in which.

DETAILED DESCRIPTION

Figure 1:
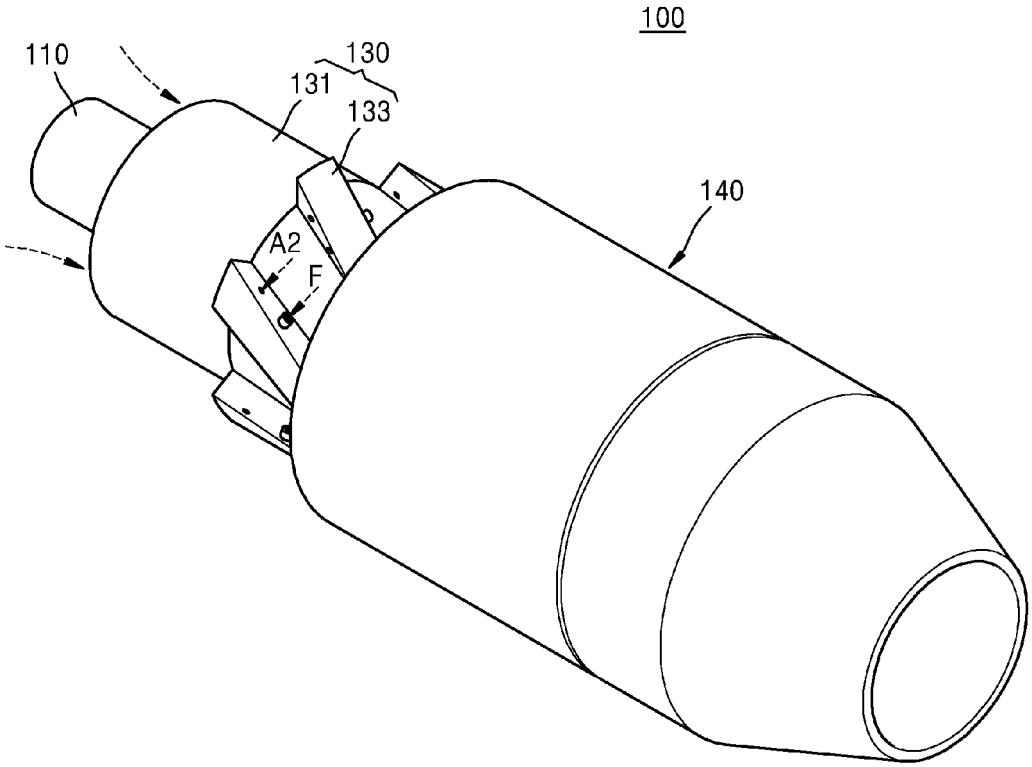
FIG. 1 is a perspective view showing a combustor according to an exemplary embodiment.

Reference will now be made in detail to exemplary embodiments, examples of which are illustrated in the accompanying drawings, wherein like reference numerals refer to like elements throughout. In this regard, the exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list. In the following exemplary embodiments, the singular forms are intended to include the plural forms as well, unless the context clearly indicates otherwise. In the following exemplary embodiments, the terms "comprises" and/or "has" when used in this specification, specify the presence of stated feature, number, step, operation, component, element, or a combination thereof but do not preclude the presence or addition of one or more other features, numbers, steps, operations, components, elements, or combinations thereof. In the following embodiments, terms such as "first", "second", and so forth are used only for distinguishing one component from another component, rather than for restrictive meanings.

Figure 2:
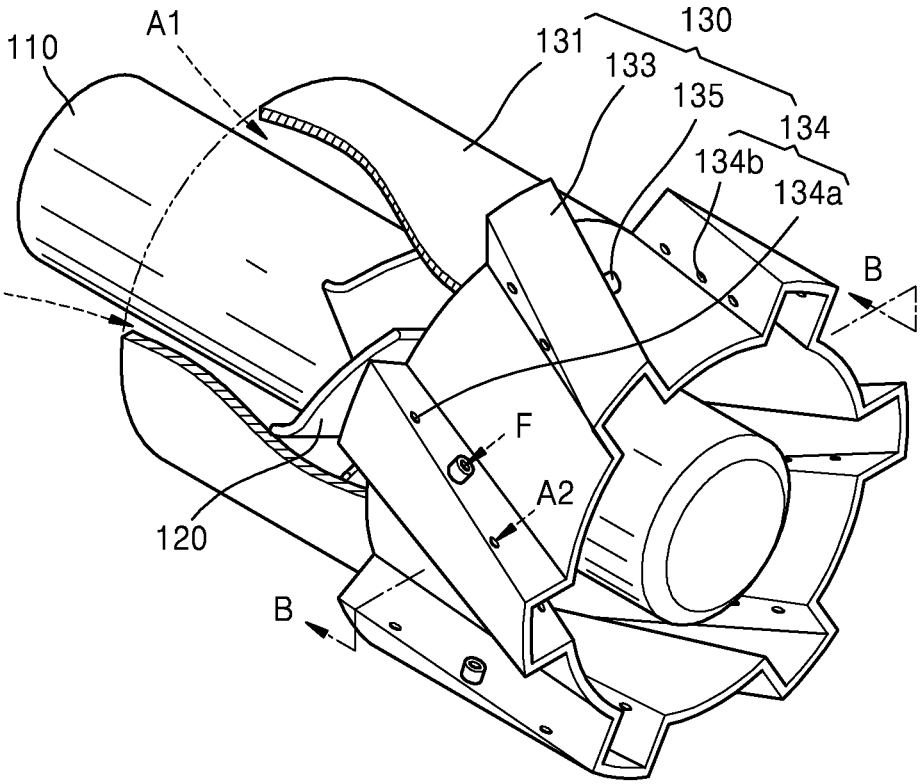
FIG. 2 is a perspective view showing a part of the combustor shown in FIG. 1 according to an exemplary embodiment.
Figure 3:
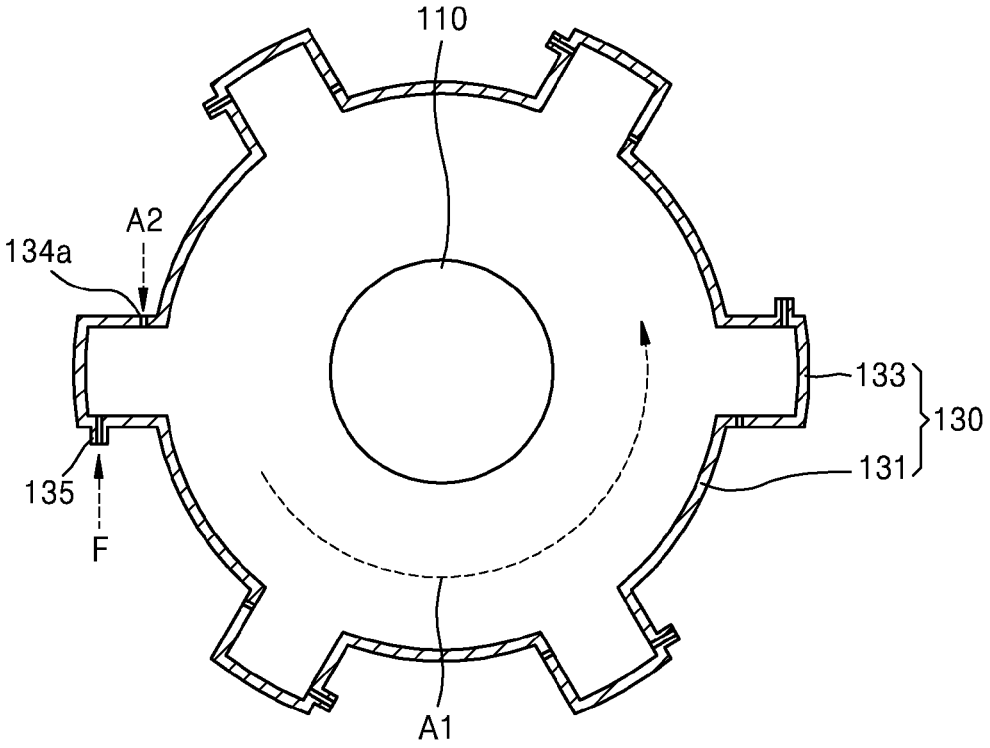
FIG. 3 is a cross-sectional view taken along a line B-B of FIG. 2 and showing a part of the combustor according to an exemplary embodiment.

FIG. 1 is a perspective view showing a combustor 100 according to an exemplary embodiment. FIG. 2 is a perspective view showing a part of the combustor 100 shown in FIG. 1 according to an exemplary embodiment. FIG. 3 is a cross-sectional view taken along a line B-B of FIG. 2 and showing a part of the combustor 100 according to an exemplary embodiment.

Referring to FIGS. 1 through 3, a combustor assembly (not shown) may include a housing (not shown) forming an exterior thereof. The combustor assembly may include a combustor 100 installed inside the housing. A plurality of combustors 100 may be provided to be spaced apart from each other inside the housing.

The combustor 100 may include a support shaft 110 disposed longitudinally along a flow direction of a first fluid A1. The support shaft 110 may be fixed in the housing and may be installed to pass through the housing.

The combustor 100 may include a wing portion 120 installed on the support shaft 110 to swirl the first fluid A1 around the support shaft 110. A plurality of wing portions 120 may be provided and may be installed spaced apart from one another on the support shaft 110. The wing portion 120 may swirl the first fluid A1 flowing in a longitudinal direction of the support shaft 110. More specifically, the wing portion 120 may be spirally installed on an outer surface of the support shaft 110 along the longitudinal direction of the support shaft 110. The first fluid A1 may move along the longitudinal direction of the support shaft 110 while swirling due to the wing portion 120.

The combustor 100 may include a cover housing 130 installed to enclose the support shaft 110 and the wing portion 120. An inner surface of the cover housing 130 may be spaced apart by a predetermined interval from the outermost portion of the wing portion 120.

The cover housing 130 may include a body portion 131 into which a portion of the support shaft 110 and the wing portion 120 are inserted. The cover housing 130 may also include a space enlarging portion 133 formed on the body portion 131 to enlarge an inner space of the body portion 131. The space enlarging portion 133 may be formed in an inner surface of the body portion 131, or may be formed to protrude from an outer surface of the body portion 131 and also formed in the inner surface of the body portion 131. However, for convenience, a case where the space enlarging portion 133 is formed to protrude from the outer surface of the body portion 131 and also formed in the inner surface of the body portion 131 will be described.

The space enlarging portion 133 may be formed on the outer surface of the body portion 131 in a convex/concave shape and provided at downstream of the wing portion 120 along a flow direction of the first fluid A1 as shown in FIG. 2. The space enlarging portion 133 may enlarge a cross-sectional area of the inner surface of the body portion 131 in parts along a circumferential direction of the body portion 131 as shown in FIG. 2. The space enlarging portion 133 may be formed on the outer surface of the body portion 131 to extend along the longitudinal direction of the support shaft 110. In particular, the space enlarging portion 133 may be formed spirally along the longitudinal direction of the support shaft 110. The space enlarging portion 133 may be formed to extend linearly along the longitudinal direction of the support shaft 110. However, for convenience, a case where the space enlarging portion 133 is extending spirally with respect to the longitudinal direction of the support shaft 110 will be described.

A plurality of space enlarging portions 133 may be provided to be spaced apart from one another by a predetermined interval on the body portion 131 along the circumferential direction. The plurality of space enlarging portions 133 may be formed to extend spirally in the same direction.

The space enlarging portion 133 may have a fluid injection hole 134 through which a second fluid A2 is injected at a first angle with respect to the flow direction of the first fluid A1. The space enlarging portion 133 may have a fuel injection hole 135 through which a fuel F is injected at a second angle with respect to the flow direction of the first fluid A1. The first angle may be different from the second angle or the first and second angles may be equal.

A plurality of fluid injection holes 134 may be provided at various positions of each space enlarging portion 133. In particular, the plurality of fluid injection holes 134 may be formed at any position of the space enlarging portion 133 where the second fluid A2 is injected into the space enlarging portion 133 to circulate therein.

For example, the plurality of fluid injection holes 134 may be formed at different heights with respect to radial direction of the body portion 131 and the space enlarging portion 133. For example, the plurality of fluid injection holes 134 may include a first fluid injection hole 134*a* formed in an upper side of the space enlarging portion 133 and a second fluid injection hole 134*b* formed in a bottom surface of the space enlarging portion 133. The second fluid A2 may be injected though the first fluid injection hole 134*a* and the second fluid injection hole 134*b* in opposite directions. The first fluid injection hole 134*a* and the second fluid injection hole 134*b* are formed at different heights of the space enlarging portion 133 so that the second fluid A2 circulates in the space enlarging portion 133.

The plurality of fluid injection holes 134 may further include, in addition to the first fluid injection hole 134*a* and the second fluid injection hole 134*b*, a third fluid injection hole (not shown) formed on a bottom surface of the space enlarging portion 133 to inject the second fluid A2 from the bottom surface of the space enlarging portion 133 to the upper side of the space enlarging portion 133. The second fluid A2 is injected in through the third fluid injection hole from the bottom surface of the space enlarging portion 133 to the first fluid injection hole 134*a*.

The fuel injection hole 135 is formed to be adjacent to the fluid injection hole 134 to inject the fuel F toward the space enlarging portion 133. In particular, the fuel injection hole 135 may be formed between the plurality of fluid injection holes 134.

More specifically, the fuel injection hole 135 may be formed at the same position as at least one of the first fluid injection hole 134*a*, the second fluid injection hole 134*b* and the third fluid injection hole. When the second fluid A2 is injected from the first, second and third fluid injection holes 134*a*, 134*b*, the fuel F is injected trough the fuel injection hole 135 into an inner space of the space enlarging portion 133 provided between adjacent protruding portions of the space enlarging portion 133 to be mixed with the second fluid A2.

The combustor 100 may include a combustion housing 140 that is connected with the cover housing 130, and combustion occurs inside the combustion housing 140. The combustion housing 140 is formed to have a reduced cross-sectional area at a rear surface with respect to a front surface and thus, to exhaust the combusted gas to the outside in high velocity due to the reduced cross-sectional area of the rear surface.

Hereinafter, an operation of the combustor 100 formed as described above is described. A fluid is supplied from the outside and then compressed by an operation of the compressor (not shown), and then the compressed fluid is supplied to the combustor assembly. The fluid may be air or may be a separate gas. However, for convenience, a case where the fluid is the air will be described.

The fluid (i.e., the air) supplied to the combustor assembly may include the first fluid A1 that enters the housing and is directly introduced to the combustor 100 and a second fluid A2 that moves along the cover housing 130 and then is supplied to the fluid injection hole 134.

Once the first fluid A1 enters the cover housing 130, the first fluid A1 moves along the support shaft 110 due to a pressure difference and generates a swirl while passing through the wing portion 120. The first fluid A1 passes through the wing portion 120, continuously moves in the housing, and reaches the space enlarging portion 133.

In this case, the second fluid A2 moving along the cover housing 130 circulates in the space enlarging portion 133 through the fluid injection hole 134. The fuel F injected through the fuel injection hole 135 may also circulate, together with the second fluid A2, in the space enlarging portion 133.

As such, when the second fluid A2 and the fuel F circulate, the second fluid A2 and the fuel F may move spirally from the space enlarging portion 133 to the rear surface of the cover housing 130 along a movement of the first fluid A1. At an end of the space enlarging portion 133, a vortex tube may be formed as the first fluid A1, the second fluid A2, and the fuel F move away.

Due to the vortex tube formed as described above and swirls of the first fluid A1, the second fluid A2, and the fuel F, a recirculation area may be formed on the rear surface of the cover housing 130 in which a swirl is formed.

At this time, combustion occurs due to energy applied from an ignition unit (not shown) provided in one of the housing, the cover housing 130, and the combustion housing 140, thus the combustor assembly operates accordingly.

Hence, the first fluid A1 is rapidly mixed with the fuel F in the combustor 100 through the space enlarging portion 133. Due to the fluid injection hole 134 and the fuel injection hole 135 a mixing rate of the fuel F and the second fluid A2 is improved, incomplete combustion of the fuel F may be minimized.

The combustor 100 may increase the overall efficiency of the gas turbine by improving the combustion efficiency of the fuel F.

Figure 4:
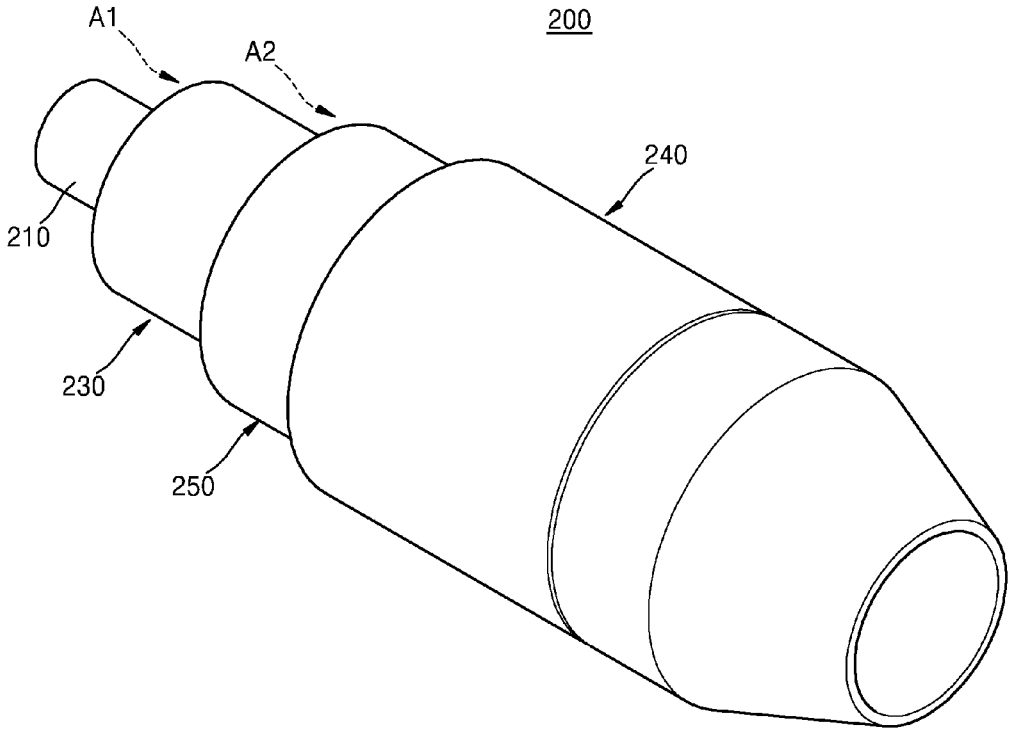
FIG. 4 is a perspective view showing a combustor according to another exemplary embodiment.
Figure 5:
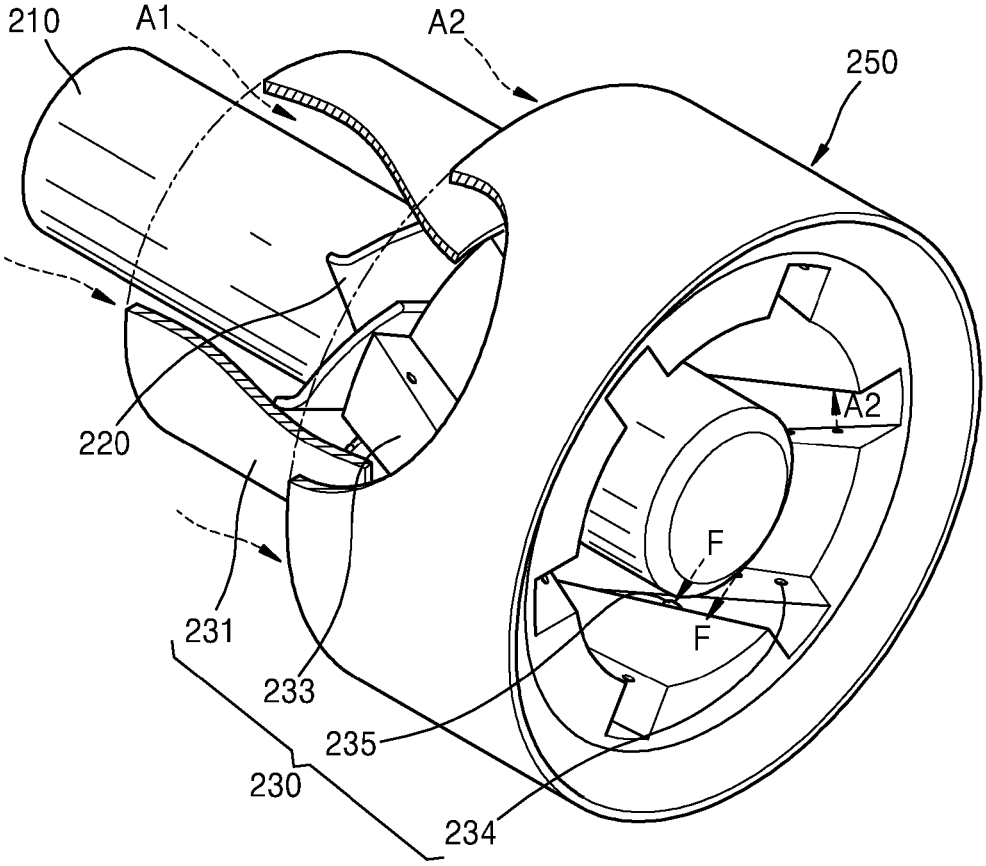
FIG. 5 is a perspective view showing a part of the combustor shown in FIG. 4 according to an exemplary embodiment.

FIG. 4 is a perspective view showing a combustor 200 according to an exemplary embodiment. FIG. 5 is a perspective view showing a part of the combustor 200 shown in FIG. 4 according to an exemplary embodiment.

Referring to FIGS. 4 and 5, the combustor 200 may include a support shaft 210, a wing portion 220, a cover housing 230, and a combustion housing 240. The support shaft 210, the wing portion 220, the cover housing 230, and the combustion housing 240 are the same as or similar to those described above and thus will not be described in detail.

The combustor 200 may include a guide housing 250 formed between the cover housing 230 and the combustion housing 240 to increase an inner diameter. The guide housing 250 may be installed to enclose an outer surface of the space enlarging portion 233. In particular, the guide housing 250 is formed to enclose the cover housing 230 to completely cover a space between adjacent space enlarging portions 233, thus forming a flow path of the second fluid A2.

More specifically, an inner diameter of the guide housing 250 may be equal to or less than a maximum distance of an outer surface of the body portion 231 where the space enlarging portion 233 is formed. The guide housing 250 may be installed to completely enclose the outer surface of the body portion 231 in which the space enlarging portion 233 is formed. A portion of the guide housing 250 may protrude from an end of the body portion 231, and the protruding portion of the guide housing 250 may be connected to the combustion housing 240.

As to an operation of the combustor 200 formed as described above, the first fluid A1 swirls by the wing portion 220 while moving along the longitudinal direction of the support shaft 210.

After entering a space between the guide housing 250 and the body portion 231, the second fluid A2 is injected in the space enlarging portion 233 through the fluid injection hole 234. The fuel F is injected in the space enlarging portion 233 through the fuel injection hole 235, and the first fluid A1, the second fluid A2, and the fuel F are mixed in the space enlarging portion 233 and move sequentially to the cover housing 230, the guide housing 250, and then the combustion housing 240.

The first fluid A1, the second fluid A2, and the fuel F are uniformly mixed due to the second fluid A2 and the fuel F injected into the space enlarging portion 233, and a vortex tube may be formed at an end of the space enlarging portion 233.

Thus, the combustor 200 may prevent combustion instability of as the first fluid A1, the second fluid A2, and the fuel F are uniformly mixed and combusted. Moreover, the guide housing 250 of the combustor 200 may remove flow noise caused by turbulence.

Figure 6:
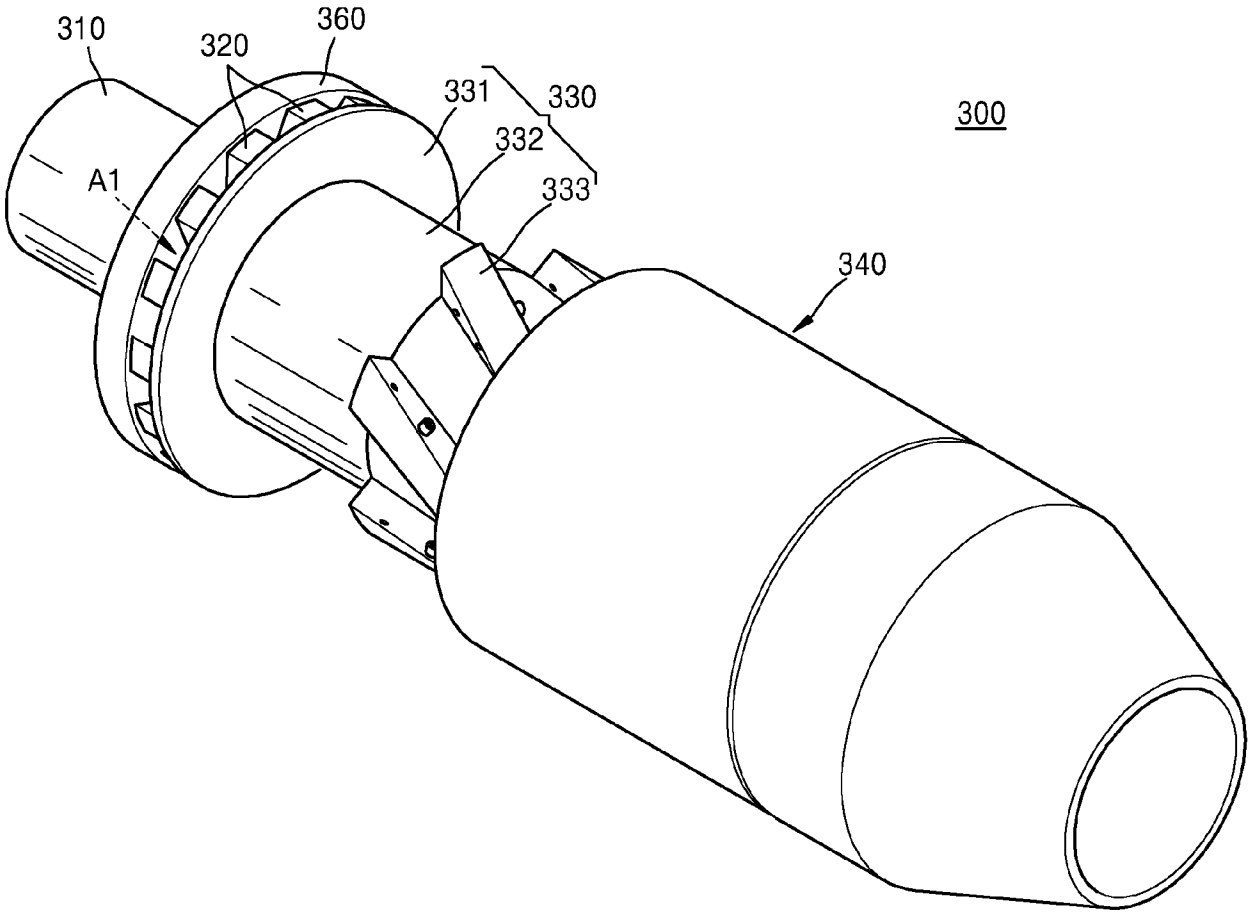
FIG. 6 is a perspective view showing a combustor according to another exemplary embodiment.
Figure 7:
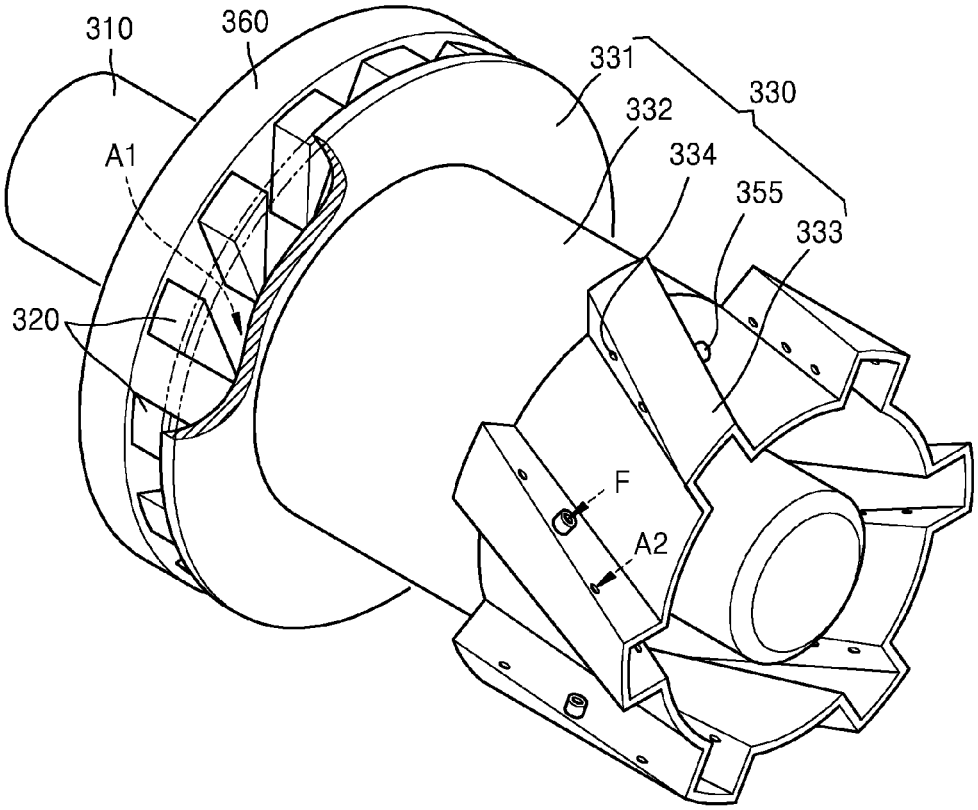
FIG. 7 is a perspective view showing a part of the combustor shown in FIG. 6 according to an exemplary embodiment.

FIG. 6 is a perspective view showing a combustor 300 according to an exemplary embodiment. FIG. 7 is a perspective view showing a part of the combustor shown in FIG. 6 according to an exemplary embodiment.

Referring to FIGS. 6 and 7, a combustor assembly (not shown) may include a housing (not shown) and the combustor 300 installed inside the housing. The combustor 300 may include a support plate 360 fixedly installed in the housing.

The combustor 300 may include a support shaft 310 installed on the support plate 360. The support shaft 310 may be installed perpendicularly to the support plate 360. The support shaft 310 may be installed to pass through the support plate 360 or may be installed such that an end of the support shaft 310 is bonded to the support plate 360. However, for convenience, a case where the support shaft 310 is installed to pass through the support plate 360 and is fixed in the housing will be described.

The combustor 300 may further include a wing portion 320 installed on the support plate 360. The wing portion 320 may be installed radially with respect to the support shaft 310. In particular, the wing portion 320 guides the first fluid A1 introduced from a side of the support plate 360 toward a center of the support plate 310 and swirls the first fluid A1. A plurality of wing portions 320 may be provided and a space may be formed between the plurality of wing portions 320 to allow the first fluid A1 to pass therethrough.

The combustor 300 may include a cover housing 330 installed to enclose the support shaft 310 and the wing portion 320. The cover housing 330 may include a first body portion 331 disposed in an upper side of the wing portion 320 along a longitudinal direction of the combustor 300. The first body portion 331 may be disposed spaced apart from the support plate 360 in a longitudinal direction of the support shaft 310 by a predetermined interval to guide the first fluid A1 introduced from the side of the support plate 360. In particular, the wing portion 320 may be installed between the support plate 360 and the first body portion 331 to swirl the first fluid A1 as described above.

The cover housing 330 may include a second body portion 332 connected with the first body portion 331 and formed to enclose the support shaft 310. The second body portion 332 has a uniform diameter in order to guide the first fluid A1, which swirls around the first body portion 331, along the longitudinal direction of the support shaft 310.

The cover housing 330 may include a space enlarging portion 333 which is formed to be connected with the second body portion 332 and is at a different distance from an outer surface of the support shaft 310 than other portions of the cover housing 330. The space enlarging portion 333 may be a body formed inwardly from an inner surface of the second body portion 332 or a space formed on the inner surface and the outer surface of the second body portion 332 in a convex/concave shape. However, for convenience, a case where the space enlarging portion 333 is formed on the second body portion 332 in a convex/concave shape will be described. The space enlarging portion 333 is the same as or similar with that described above and thus will not be described in detail.

A fluid injection hole 334 and a fuel injection hole 335 may be formed in the space enlarging portion 333. The fluid injection hole 334 and the fuel injection hole 335 are the same as or similar with those described above and thus will not be described in detail.

The combustor 300 may include a guide housing (not shown) installed to enclose the cover housing 330 in addition to the above-described components. The guide housing is installed to partially enclose the second body portion 332 and the space enlarging portion 333, and a portion of the guide housing is formed to protrude from an end of the second body portion 332 where the space enlarging portion 333 is formed. In particular, the guide housing is the same as or similar with that described above and thus will not be described in detail. However, for convenience, a case where the combustor 300 does not include the guide housing will be described.

Hereinafter, an operation of the combustor 300 formed as described above is described. When the gas turbine operates as described above, a compressor (not shown) operates to supply the first fluid A1 and the second fluid A2 to the combustor assembly. The first fluid A1 and the second fluid A2 introduced into the housing may be respectively introduced between the support plate 360 and the first body portion 331 or into the space enlarging portion 333 through the fluid injection hole 334.

The first fluid A1 has a spiral flow due to the wing portion 320, and moves through the first body portion 331 and the second body portion 332 to a portion where the space enlarging portion 133 is formed.

When the second fluid A2 and the fuel F are injected in the space enlarging portion 333 and the first fluid A1, the second fluid A2, and the fuel F are mixed, a swirl is formed so that the mixture is injected into the combustion housing 340. At this time, fuel combustion is generated by an ignition unit (not shown) and the fuel is discharged to the outside.

In particular, when the first fluid A1, the second fluid A2, and the fuel F flow as described above, the first fluid A1, the second fluid A2, and the fuel F are uniformly mixed in the space enlarging portion 333 and a vortex tube may be formed at an end of the space enlarging portion 333.

Thus, as the first fluid A1, the second fluid A2, and the fuel F are uniformly mixed in the combustor 300, combustion instability may be minimized. Moreover, as a smooth flow is formed in the combustor 300 for securing the recirculation area, combustion efficiency is improved.

As described above, according to one or more exemplary embodiments, the combustion efficiency of the gas turbine may be improved by efficiently and uniformly diluting the compressed air and fuel.

It should be understood that the exemplary embodiments described therein should be considered in a descriptive sense only and not for purposes of limitation. Descriptions of features or aspects within each embodiment should typically be considered as available for other similar features or aspects in other embodiments.

While exemplary embodiments have been particularly shown and described above, it will be understood by those of ordinary skill in the art that various changes in form and details may be made therein without departing from the spirit and scope of the inventive concept as defined by the following claims.

What is claimed is:

1. A combustor comprising:

a support shaft;

a wing portion provided on the support shaft and configured to swirl a first fluid around the support shaft; and a cover housing enclosing the support shaft and the wing portion and comprising a space enlarging portion provided at a downstream side of the wing portion along a flow direction of the first fluid, wherein a distance between the space enlarging portion and an outer surface of the support shaft is different from distances between other portions of the cover housing and the outer surface of the support shaft, and wherein the space enlarging portion extends spirally with respect to a longitudinal direction of the support shaft.

2. The combustor of claim 1, further comprising a guide housing enclosing the cover housing.

3. The combustor of claim 1, wherein the space enlarging portion extends in a predetermined angle with respect to a longitudinal direction of the support shaft.

4. The combustor of claim 1, wherein the space enlarging portion comprises:

a fluid injection hole configured to inject a second fluid at a first angle with respect to the flow direction of the first fluid; and a fuel injection hole configured to inject a fuel at a second angle with respect to the flow direction of the first fluid.

5. The combustor of claim 4, wherein the second fluid and the fuel are configured to circulate in the space enlarging portion after being injected into the space enlarging portion through the fluid injection hole and the fuel injection hole, respectively.

6. The combustor of claim 4, wherein the fluid injection hole comprises a plurality of fluid injection holes provided at different heights of the space enlarging portion.

7. The combustor of claim 1, wherein a cross-sectional area of the space enlarging portion varies along a circumferential direction of the space enlarging portion.

8. The combustor of claim 6, wherein the plurality of fluid injection holes are provided at different heights with respect to a radial direction of the space enlarging portion.

9. The combustor of claim 4, wherein the first angle and the second angle are different from each other.

10. A combustor comprising:

a support plate;

a support shaft provided on the support plate;

a wing portion radially extending from the support plate and configured to swirl a first fluid toward a center of the support plate; and a cover housing enclosing the support shaft and the wing portion and comprising a space enlarging portion provided at a downstream side of the wing portion along a flow direction of the first fluid, wherein a distance between the space enlarging portion and an outer surface of the support shaft is different from distances between other portions of the cover housing and the outer surface of the support shaft, and wherein the space enlarging portion extends spirally with respect to a longitudinal direction of the support shaft.

11. The combustor of claim 10, further comprising a guide housing enclosing the cover housing.

12. The combustor of claim 10, wherein the space enlarging portion extends at a predetermined angle with respect to a longitudinal direction of the support shaft.

13. The combustor of claim 10, wherein the space enlarging portion comprises:

a fluid injection hole configured to inject a second fluid at a first angle with respect to the flow direction of the first fluid; and a fuel injection hole configured to inject a fuel at a second angle with respect to the flow direction of the first fluid.

14. The combustor of claim 13, wherein the second fluid and the fuel are configured to circulate inside the space enlarging portion after being injected into the space enlarging portion through the fluid injection hole and the fuel injection hole, respectively.

15. The combustor of claim 13, wherein the fuel injection hole comprises a plurality of fluid injection holes provided at different heights of the space enlarging portion.

16. The combustor of claim 10, wherein a cross-sectional area of the space enlarging portion varies along a circumferential direction of the space enlarging portion.

17. The combustor of claim 15, wherein the plurality of fluid injection holes are provided at different heights with respect to a radial direction of the space enlarging portion.

18. The combustor of claim 13, wherein the first angle and the second angle are different from each other.

* * * * *